US006884037B2

(12) United States Patent
Lacey et al.

(10) Patent No.: US 6,884,037 B2
(45) Date of Patent: Apr. 26, 2005

(54) IMPELLER ASSEMBLY

(75) Inventors: Christopher George Lacey, Upwey (AU); Mark Andrew Lance, Williamstown (AU)

(73) Assignee: Davey Products Pty Ltd, Scoresby (AU)

( * ) Notice: Subject to any disclaimer, the term of this patent is extended or adjusted under 35 U.S.C. 154(b) by 169 days.

(21) Appl. No.: 10/276,896

(22) PCT Filed: May 18, 2001

(86) PCT No.: PCT/AU01/00569

§ 371 (c)(1),
(2), (4) Date: Nov. 20, 2002

(87) PCT Pub. No.: WO01/90582

PCT Pub. Date: Nov. 29, 2001

(65) Prior Publication Data

US 2003/0138323 A1 Jul. 24, 2003

(30) Foreign Application Priority Data

May 19, 2000 (AU) ..... PQ7635

(51) Int. Cl.[7] ..... F01D 29/20

(52) U.S. Cl. ..... 416/214 R; 416/244 R

(58) Field of Search ..... 416/185, 186 R, 416/198 R, 244 R

(56) References Cited

U.S. PATENT DOCUMENTS 1,919,970 A 2/1933 Woods
6,033,183 A 3/2000 Genster ..... 416/186

FOREIGN PATENT DOCUMENTS

GB 2260788 4/1993

*Primary Examiner*—Ninh H. Nguyen
(74) *Attorney, Agent, or Firm*—Baker Botts LLP

(57) ABSTRACT

An impeller assembly includes an impeller which has a pair of plate means adapted for individual connection to a drive shaft for rotation by the drive shaft about an axis, and vane means disposed intermediate the pair of plate means and adapted for rotation with the pair of plate means. The impeller assembly further includes means for applying force parallel to the axis of the impeller to the impeller so as to clamp the pair of plate means and intermediate vane means together.

20 Claims, 6 Drawing Sheets

IMPELLER ASSEMBLY

FIELD OF THE INVENTION

This invention relates to impeller assemblies that are commonly used in pumps for liquids. In particular, this invention relates to the assembly of impeller components.

BACKGROUND OF THE INVENTION

Impeller assemblies typically include an impeller housing which is mounted on or operably connected with a central drive shaft. Attached to the shaft, within the housing, is an impeller. The impeller typically includes upper and lower cover plates and, in applications where the impeller is manufactured from pressed metal components, a vane plate located between the respective cover plates. Alternatively, the vanes of the impeller may be formed integrally with one or both cover plates. Fluid to be pumped is introduced into the impeller housing at one side thereof. The shaft rotates so as to rotate the impeller assembly thereby creating regions of high and low fluid pressure within the impeller housing and impelling fluid through the assembly.

Depending on the application of the pump, a pump can be a single-stage model i.e. having one impeller assembly, or a multi-stage model i.e. having a number of impeller assemblies in series on the same shaft passing through each of the impeller housings.

Typically, the lower cover plate of the impeller assembly incudes a central boss, formed integrally with the cover plate. The central boss defines an aperture and receives the drive shaft of the impeller assembly. The boss is typically keyed to the drive shaft so that the drive shaft directly drives the lower cover plate. The vane plate and upper cover plate have central apertures, considerably larger than the drive shaft and are located over the boss of the lower plate. The vane plate and upper cover plate are fastened to the lower cover plate e.g by welding at the vanes, gluing, or riveting. As such, the load of the entire impeller is carried by the lower cover plate as it is rotated by the drive shaft.

This distribution of load can lead to several problems when the impeller is in operation, particularly during acceleration/deceleration which may be experienced during start up or engine braking or may be due to the introduction of a foreign object into the pump housing. Because the lower cover plate only is being driven, the inertial loads of the entire impeller are transmitted to the drive feature of the lower cover plate. This plate must be accordingly stronger to resist these loads, which typically leads to a heavier, more expensive, drive feature requirement.

In the case of a laminated, pressed metal impeller, the lower plate is typically manufactured from thicker gauge material to compensate for the extra loading. In a diecast impeller, extra thickness is added locally around the drive.

Manufacture of an impeller assembly in this manner is time consuming and labour intensive, requiring, in the case of welding, numerous spot welds between the lower cover plate and the vane plate, and between the vane plate and the upper cover plate. The plates must be securely fixed together so as to prevent slippage and fluid flow between the plates.

In the case of plastic impellers, welding can introduce variation in the axial length of the impeller assembly. With too much welding, this length is reduced, leading to a reduction in the impeller flow output. With insufficient welding, the impeller axial length will be increased, potentially leading to overloading of the drive motor.

Mechanical fastening, in the form of riveting can lead to failure due to fretting and is also known to lead to corrosion problems, as materials are more prone to stress induced corrosion after riveting.

Permanent fastening of the impeller components also prevents easy dismantling and replacement of individual components in the assembly if they become worn or faulty.

The above disadvantages are of course amplified when the pump is a multi-stage model. In particular, variation in the axial length of individual assemblies is multiplied, leading to fitment problems on mating seal components, in addition to the performance variation described previously.

It is therefore an object of the invention to provide an impeller assembly that at least in part alleviates one or more of the above disadvantages.

SUMMARY OF THE INVENTION

The invention accordingly provides an impeller assembly including:

an impeller, the impeller including:

a pair of plate means adapted for individual connection to a drive shaft for rotation by the drive shaft about an axis; and vane means disposed intermediate the pair of plate means and adapted for rotation with said pair of plate means;

wherein the impeller assembly further includes means for applying force parallel to the axis of the impeller to the impeller so as to clamp the pair of plate means and intermediate vane means together.

Advantageously, the pair of plate means define upper and lower cover plates of the impeller. Each of the upper and lower cover plates and the vane means preferably include a central aperture adapted to receive the drive shaft. The respective central apertures are preferably keyed to the shaft such that each impeller component is separately driven by the drive shaft. The central apertures, and a corresponding portion of the exterior surface of the drive shaft, may be formed with pair of opposed flats, or may be octagonal or hexagonal, for example.

Advantageously, the vane means define fluid flow paths and are located intermediate the upper and lower cover plates. One or both of the pair of plate means may incorporate the vane means. Preferably, the vane means are formed integrally with the lower cover plate. Alternatively, the vane means may be a separate vane plate which is disposed between the upper and lower cover plates.

Preferably, the drive shaft includes a portion larger in diameter than the keyed portion of the shaft thereby defining a step. When the impeller is assembled, the lower cover plate advantageously sits adjacent and is pressed against the step of the shaft.

The impeller assembly preferably further includes a generally cylindrical spacer means. One end of the spacer means if preferably received within a central portion of the upper cover plate. The end of the spacer not received by the upper cover plate serves as a support for either the lower cover plate of the next impeller in series in multi-stage model pumps, or for the tightening nut, depending on the location of the impeller within the pump.

In one embodiment of the invention, the means for applying force to the impeller is preferably a combination of the stepped shaft, a tightening nut, and one or both of the pair of plate means.

In this embodiment, the outside annular portion of the upper cover plate surrounding the central aperture, is tapered downwardly and outwardly from the central aperture. When force is applied to the upper cover plate by the tightening nut, the tapered portion is forced downwardly and caused to deform outwardly against the adjacent lower cover plate or vane means.

The outside annular portion of the lower cover plate surrounding the central aperture may also be tapered, in this case, upwardly and outwardly from the central aperture. When force is applied to the lower cover plate by the tightening nut, the tapered portion of the lower cover plate is forced upwardly and caused to deform outwardly against the adjacent upper cover plate or vane means.

Deformation of either or both of the upper and lower cover plates assists in maintaining pressure and therefore a seal between the impeller components.

One end of the drive shaft preferably includes a screw thread or similar corresponding to a screw thread on the tightening nut. The tightening nut is fitted to the drive shaft and as it is tightened, respective spacers and impeller plates in the impeller assembly are clamped against the stepped portion at the opposite end of the drive shaft.

The invention also extends to a pump for liquids, the pump including an impeller housing having an inlet port and an outlet port, and at least one impeller assembly, according to an embodiment of the invention, located between the inlet port and the outlet port and operable to impel liquid from the inlet port to the outlet port.

Preferably, the pump includes a plurality of impeller assemblies arranged in series between the inlet port and outlet port.

BRIEF DESCRIPTION OF THE DRAWINGS

The invention will now be described by way of example, with reference to the accompanying drawings, in which.

DESCRIPTION OF THE PREFERRED EMBODIMENTS

Figures 1, 2:
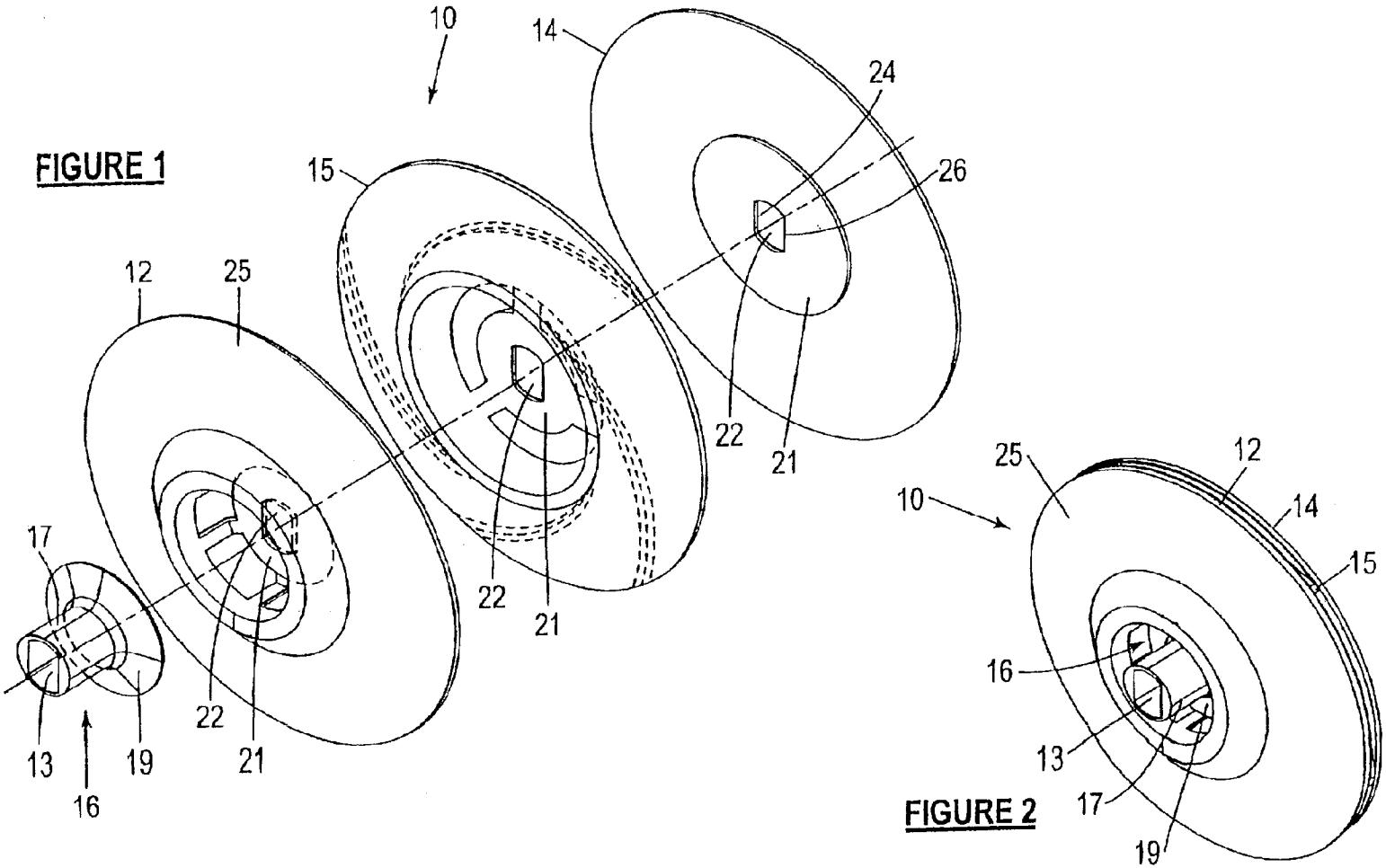
FIG. 1 is an isometric exploded view of an impeller assembly according to a first embodiment of the invention.
FIG. 2 is an isometric view of the impeller assembly of FIG. 1 when constructed.

Referring to the drawings, FIG. 1 illustrates the primary components of an impeller assembly according to a first embodiment of the invention. The impeller assembly illustrated includes an impeller 10 having upper and lower cover plates 12, 14 and vane plate 15. In the context of this specification, the terms "upper" and "lower" do not indicate a particular orientation of the components or the assembly, or a particular relative position, but are employed as is commonly the practice in this art for distinguishing purposes or perhaps to indicate a likely arrangement in use.

Vane plate 15 may be constructed in any conventional manner. The vanes of vane plate 15 may be formed integrally on the interior face of the lower cover plate such that they are intermediate the lower and upper cover plates. The vanes extend between the upper and lower plates so as to form passageways for fluid from the centre of the impeller to the outer edge of the impeller. The vanes are typically involute and serve to create regions of high and low pressure within the impeller assembly, as it is rotated at high speed, so as to impel fluid through the assembly.

Vane plate 15 is typically of pressed metal construction, however in this design it may instead be manufactured from a relatively soft polymeric material so as to improve sealing between the impeller components.

Figure 3:
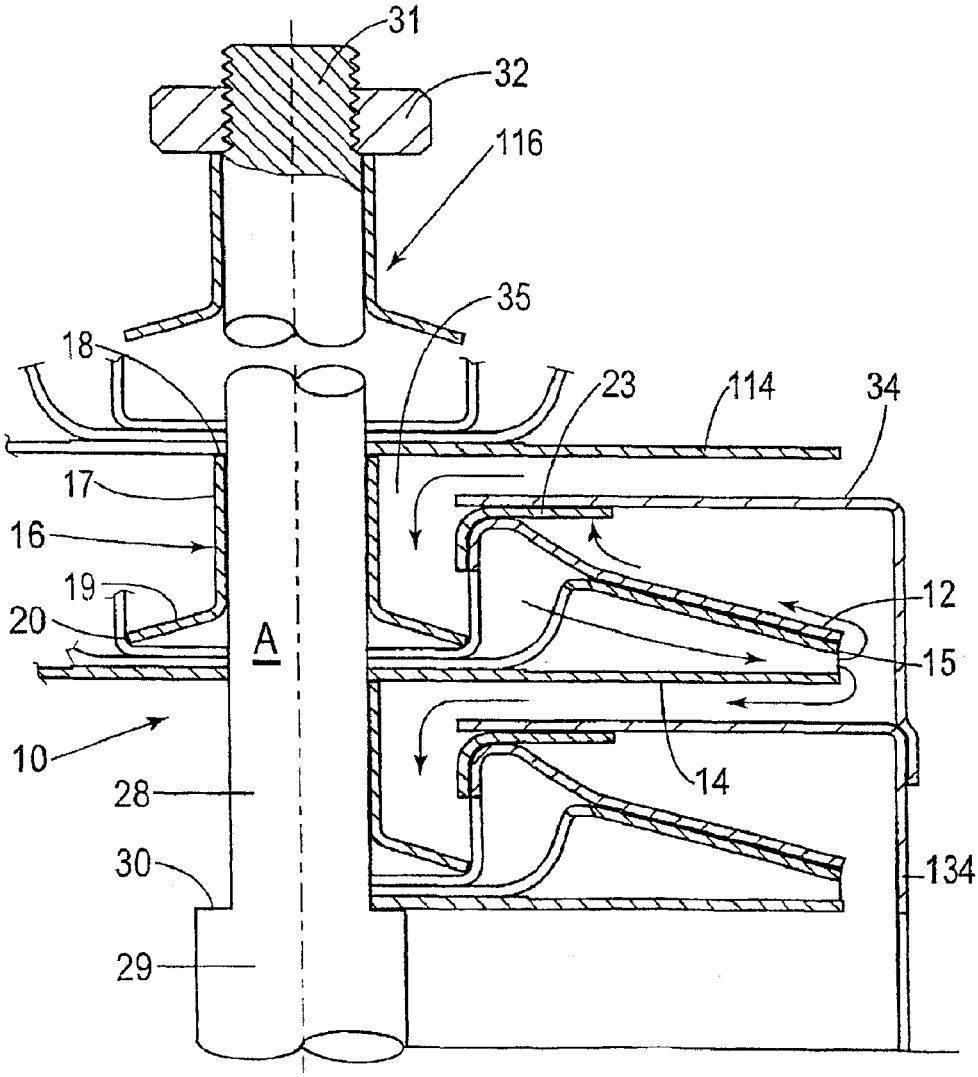
FIG. 3 is a partial side cross-sectional view of a multistage pump incorporating the impeller assembly of FIG. 1.

As shown in FIG. 3, the impeller 10 is received within impeller housing 34. Housing 34 includes central aperture, or 'eye', 35 through which a rotatable drive shaft 28 passes. Housing 34' illustrated in FIG. 3 serves to separate different areas of pressure within the pump housing and between individual impellers in series in multi-stage model pumps.

The arrows in FIG. 3 indicate the direction of fluid flow through the impeller. The impeller assembly includes various seals such as 23 which ensure that the pump housing the impeller assemblies is substantially fluid tight.

FIG. 3 illustrates the general orientation of the impeller components relative to each other in a multi-stack model pump. It will be appreciated that the scale of the components shown in FIG. 3 has been exaggerated in the axial direction for clarity. As illustrated, in this embodiment, lower cover plate 14 is a flat annular plate, and vane plate 15 is shaped to define a number of vanes as described above. Each of the lower cover plate 14, vane plate 15, and upper cover plate 12, includes a central portion 21 which defines a central aperture 22. The central portion 21 of upper cover plate is recessed or well-shaped so that it can receive the end of spacer 16, as described below, while the outside portion 25 of upper cover plate overlies the vanes of vane plate 15. The central portions 21 of plates 12, 14, 15 are adapted to lie in face-to-face contact when the impeller is assembled, with the vane plate sandwiched between the other two. Each of the plates is the same diameter.

A collar spacer 16 is provided and serves the dual purpose of spacing adjacent impeller assemblies in series in multi-stage pumps, and as a means for nut 32 to act on, as described below. Spacer 16 is generally cylindrical and has an upper end 18 and lower end 17. Lower end 17 is received within the central portion 21 of upper cover plate 12. Drive shaft 28 extends coaxially through the hollow interior 13 of collar spacer 16.

In one embodiment of the invention, the lower end 17 of spacer 16, may be formed as a broadly flared or frustoconical portion 19. The flared or frustoconical portion 19 extends radially from the lower end 17 to an annular end face 20, as best illustrated in FIG. 3. In this embodiment, the flared or frustoconical portion 19 acts as a diaphragm, eliminating freeplay between individual components. When a force is applied to the upper end 18 of the collar spacer 16, the frustoconical portion 19 is forced downwardly and is caused to deform outwardly against the facing surface of the upper cover plate, generating an opposing axial load. This loading assists in maintaining the pressure applied to the impeller components thereby maintaining them in a substantially fluid tight relationship and also acts as a brake on the locking nut 32, preventing accidental disengagement.

As described above, shaft 28 is keyed to receive the impeller plates. This keyed region is indicated at "A" in FIG. 3. One end 29 of the shaft 28 is not keyed and has a larger diameter than portion "A" so as to create an annular step 30.

Lower cover plate 14 of the impeller assembly sits against step 30 when the impeller plates are located on the drive shaft 28. The opposite end 31 of the shaft 28 is provided with a screw thread or similar to receive nut 32.

To assemble the impeller assembly, the lower cover plate 14, vane plate 15, and upper cover plate 12, are placed on the shaft 28 in sequence, such that lower cover plate 14 sits against step 30. Spacer 16 is then placed on the shaft such that lower end 17 is received by upper cover plate 12. If the pump is a multi-stage model, successive impeller assemblies are mounted on the shaft, such that a spacer 16 is always placed on the shaft last. Nut 32 is then tightened onto the shaft against the upper end 18 of the exposed spacer 16 thereby pressing spacer 16 and subsequent spacers against step 30. As a result, the impeller plates are tightly pressed together thereby forming an assembly of impellers. When it is necessary to remove or replace one or more of the impeller plates, the nut 32 is removed and the impeller plates removed and replaced as required.

Figure 4:
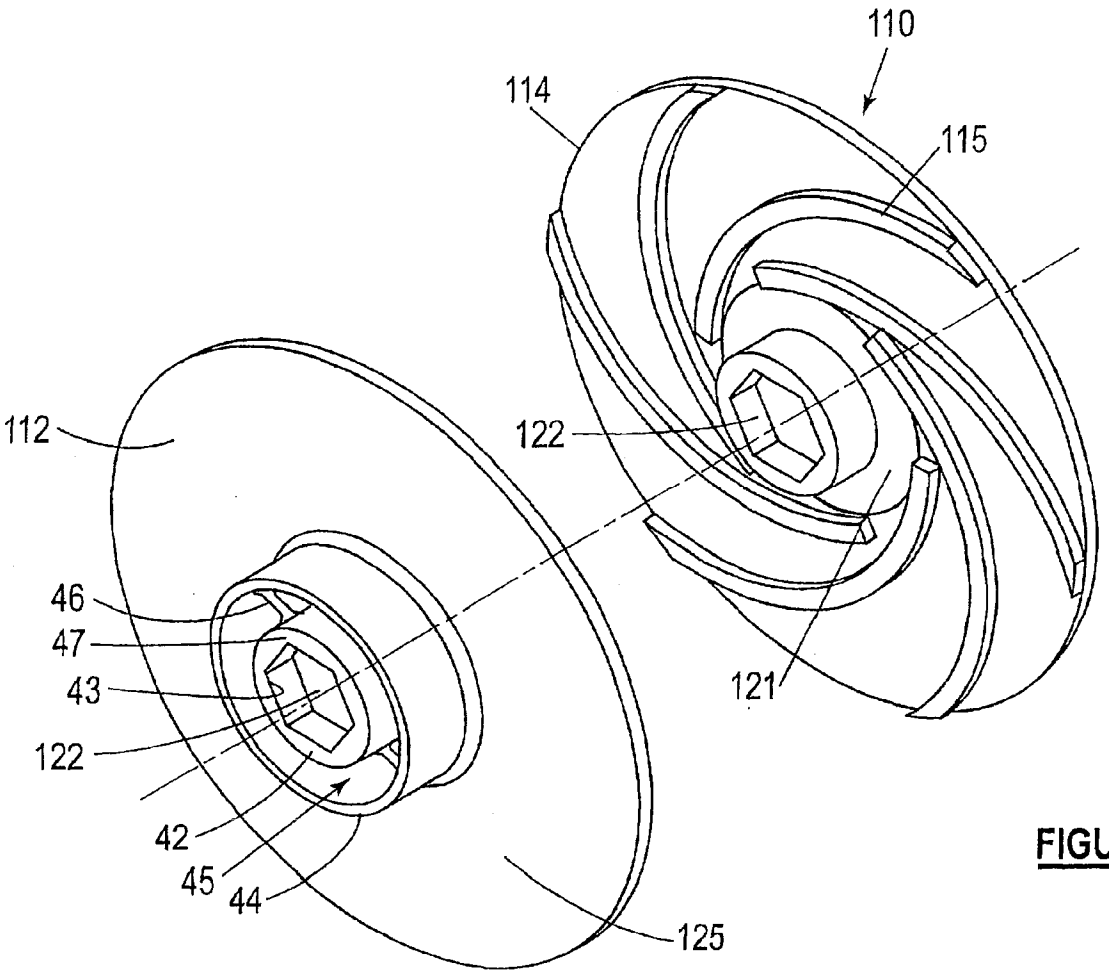
FIG. 4 is an isometric exploded view of an impeller assembly according to a second embodiment of the invention.
Figure 5:
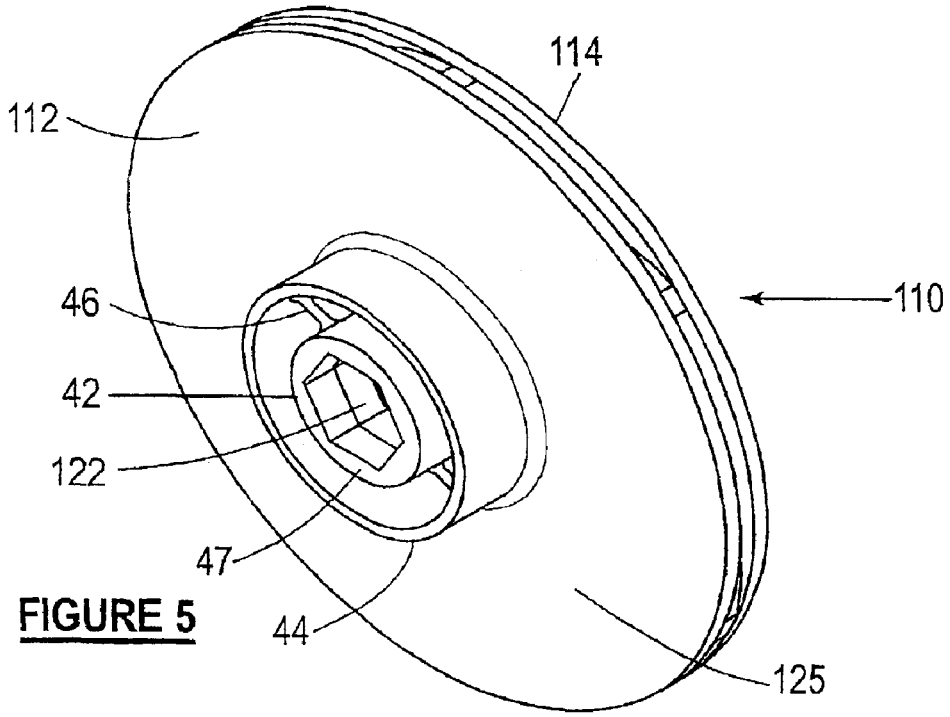
FIG. 5 is an isometric view of the impeller assembly of FIG. 4 when assembled.
Figure 6:
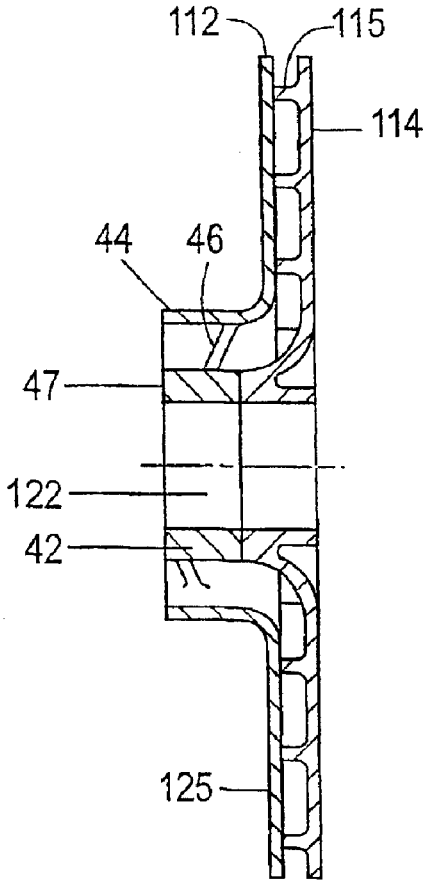
FIG. 6 is a side cross-sectional view of the impeller assembly of FIG. 5.

An impeller assembly according to a second embodiment of the invention is illustrated in FIGS. 4 to 6. In these Figures, the same reference numerals (with 100 added) are used to indicate features similar to those of the first embodiment.

Referring to FIG. 4, the impeller assembly 110 includes an impeller having upper and lower cover plates 112, 114. Vanes 115 are formed integrally with the lower cover plate 114 during casting or moulding. Vanes 115 are formed on the surface of lower cover plate 114 facing upper cover plate 112 such that the vanes are disposed intermediate the pair of cover plates 112, 114. The vanes 115 form passageways for fluid from the centre of the impeller to the outer edge of the impeller as described above. The impeller assembly 110 is received within an impeller housing substantially the same as the impeller housing 34 illustrated in FIG. 3.

As shown in FIGS. 4 and 6, lower cover plate 114 is a substantially flat annular plate with vanes 115 formed on one surface thereof. The lower cover plate 114 includes a central portion 121 which defines a central aperture 122. Central aperture 122 receives a rotatable drive shaft (not shown). In this embodiment, the central aperture 122 is a hexagonal shape. The exterior surface of central drive shaft is preferably also a hexagonal shape such that the lower cover plate is keyed to the drive shaft for rotation thereby.

Upper cover plate 112 also includes a central aperture 122. The interior walls 43 of the central aperture 122 define a hexagon which corresponds to the exterior surface of the drive shaft as for the lower cover plate 114. Spaced radially from the central aperture is an annular flange 44 extending coaxially with the drive shaft. The annular region 45 between the annular flange 44 and the central aperture 122 is spanned by a plurality of support members 46 which connect the annular flange 44 to the central aperture 122. The annular region 45 is left substantially open to allow fluid flow into the impeller assembly 110. The support members 46, are preferably formed as additional impeller blades, thereby increasing the efficiency of the impeller.

As best illustrated in FIG. 6, upper cover plate 112 is not a flat annular plate. Instead, the outside portion 125 of the upper cover plate 112 is slightly tapered downwardly and outwardly from the central aperture 122. The upper cover plate 112 is thereby pre-loaded as will be described below. The central apertures 122 are adapted to lie in face-to-face contact when the impeller is assembled on the drive shaft.

In multi-stage model pumps, subsequent impeller assemblies are located on the drive shaft in series. These multiple impeller assemblies are separated by a collar spacer (not shown). The collar spacer is generally cylindrical tube. The collar spacer is located on the drive shaft between adjacent upper and lower cover plates in series and serves the dual purpose of spacing adjacent impeller assemblies in series in multi-stage pumps, and as a means for a nut (32 as shown in FIG. 3) to be tightened against. As described in relation to the first embodiment, (see FIG. 3) one end 29 of the drive shaft 28 has larger diameter than the keyed portion "A" of the shaft so as to create an annular step 30. Lower cover plate 114 of the impeller assembly sits against the step 30 when the impeller plates are located on the drive shaft 28. The opposite end of the shaft 28 is provided with a screw thread or similar to receive nut 32. The collar spacer may be formed integrally with one or both of the cover plates of the impeller assembly.

The tapered outside portion 125 of the upper cover plate 112 acts as a diaphragm in the same manner as the flared or frustoconical portion 19 of the first embodiment of the invention. When a force is applied to the upper annular face 47 of the central portion 121, (either by the spacer or nut 32 depending on where the impeller assembly is located in the stack), the tapered portion 125 is forced downwardly and is caused to deform outwardly against the vanes 115 on the lower cover plate 114. This loading assists in maintaining the pressure applied between the impeller components and eliminates freeplay between individual components.

Figure 7:
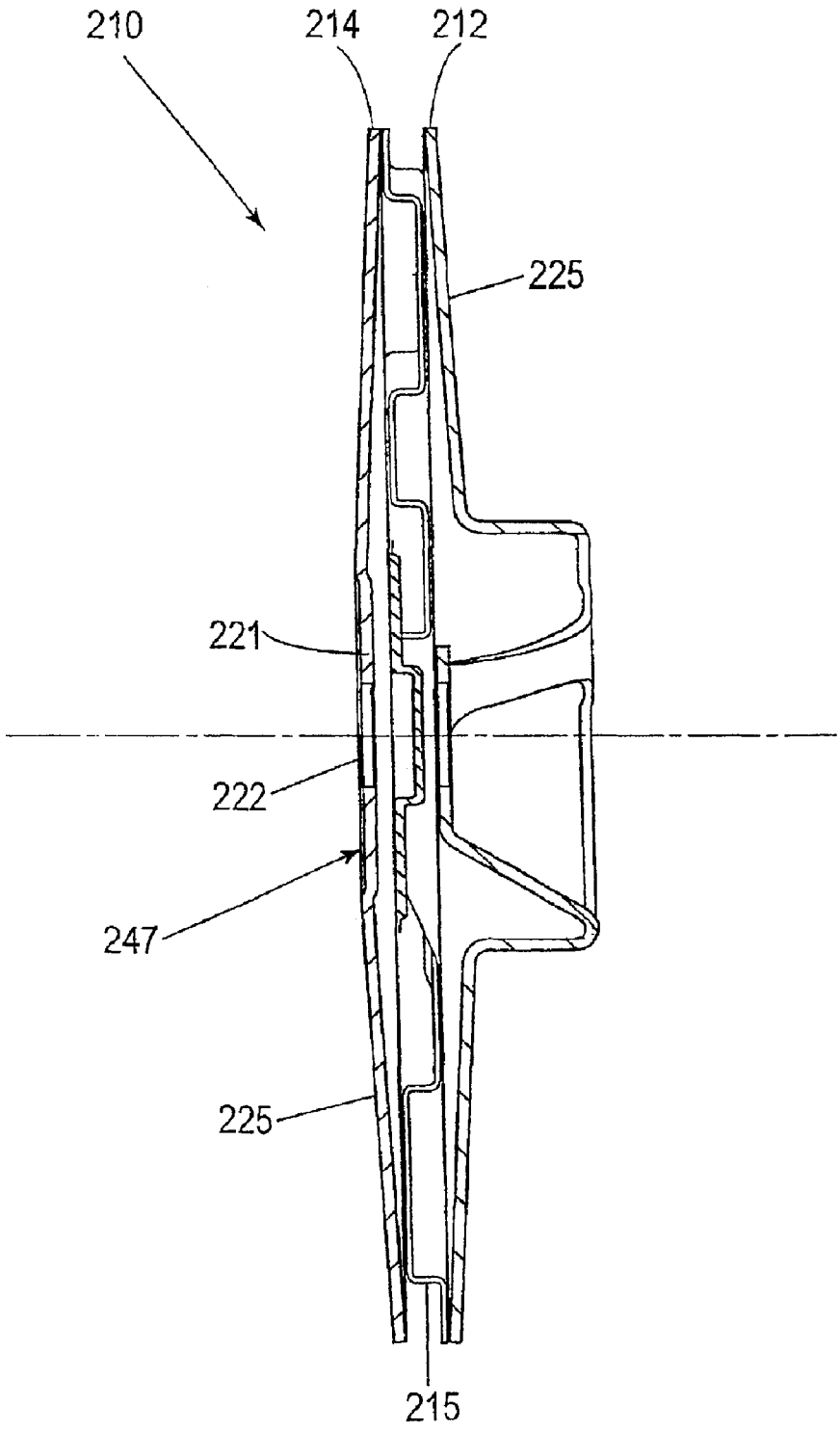
FIG. 7 is a side cross-sectional view of an impeller assembly according to a second embodiment of the invention.
Figure 8:
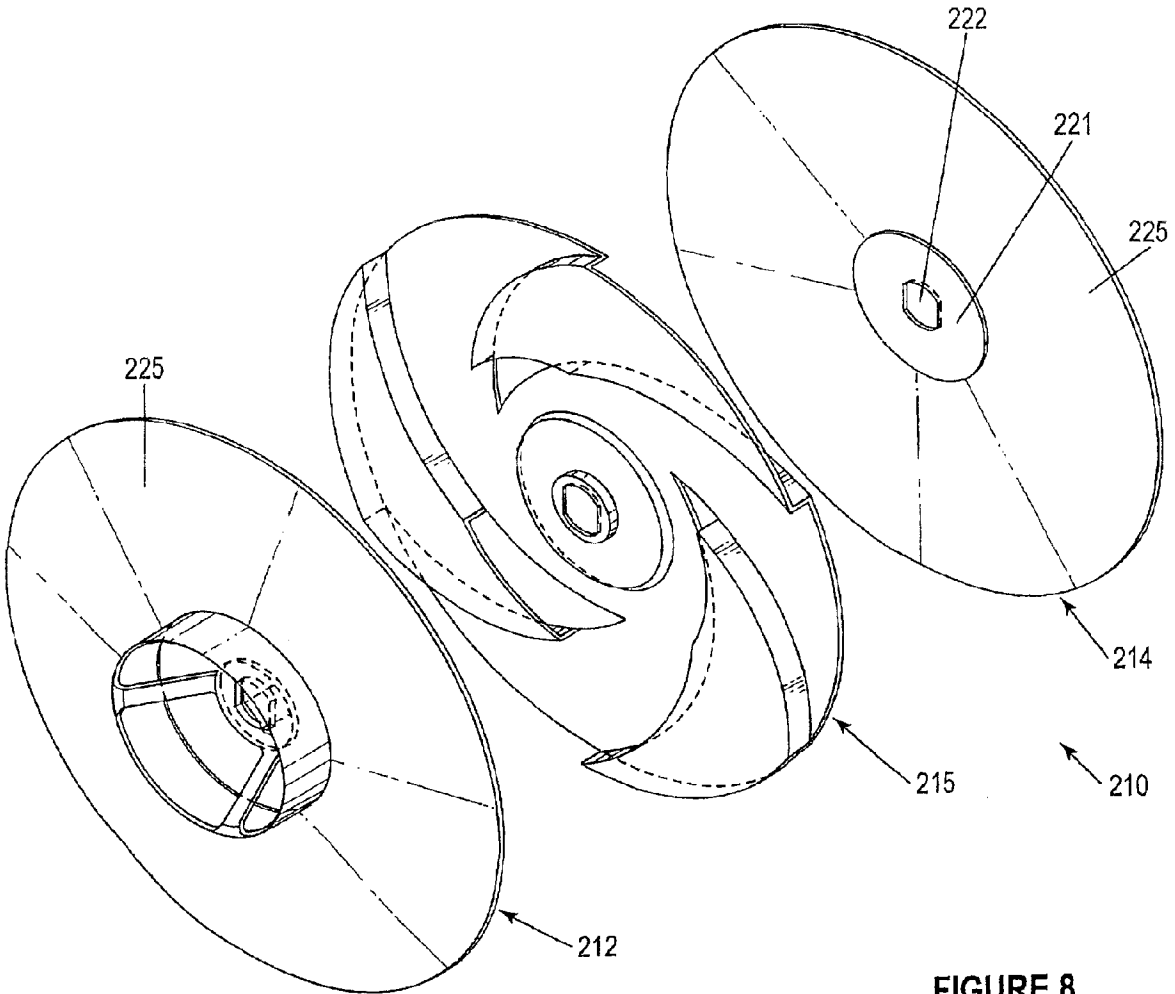
FIG. 8 is an isometric exploded view of the impeller assembly of FIG. 7.

In a third embodiment of the invention, illustrated in FIGS. 7 and 8, vane plate 215 is formed as a separate component, as in the first embodiment, and includes central portion 221 which defines a central aperture 222. In this embodiment, the outside portion 225 of the lower cover plate 214 is slightly tapered upwardly and outwardly from the central aperture 222.

As in previous embodiments, upper and lower cover plates 212, 214 also include central portions 221 and central apertures 222, and each of the upper and lower cover plates are the same diameter.

As best illustrated in FIG. 7, the outside portion 225 of the lower cover plate 214 is tapered upwardly and outwardly towards vane plate 215. The lower cover plate 214 is thereby pre-loaded, in addition to the upper cover plate 212 which is pre-loaded as described in relation to the second embodiment of the invention above.

When a force is applied to the lower annular face 247 of the central portion 221 of the lower cover plate 215, the tapered portion 225 is forced upwardly and is caused to deform outwardly against the vane plate 215.

Loading the impeller assembly from both sides using the upper and lower cover plates 212, 214, further increases the pressure applied between the components of the impeller assembly and substantially eliminates freeplay between individual components.

The impeller assembly 110, 210 of the second and third embodiments is assembled in a similar manner to the impeller assembly 10 of the first embodiment of the invention. Lower cover plate, vane plate and upper cover plate are placed on the drive shaft in sequence, such that lower cover plate sits against step 30. The spacer is then placed on the shaft and, if the pump is a multi-stage model, successive impeller assemblies and spacers are mounted on the shaft. Nut 32 is then tightened onto the shaft against the upper face of the upper cover plate, or against a spacer. The impeller plates are tightly pressed together as the nut 32 is tightened and the tapered portion of the upper cover plate and/or lower cover plate is forced to deform, thereby forming an assembly of impellers.

It will be appreciated that the impeller assembly of the invention is easy and relatively quick to assemble, and disassemble when required. Because each of the impeller components is individually keyed to the drive shaft, mechanical fastening of individual components to each other is no longer required and the product is made inherently more reliable. Additionally, the load of the entire impeller assembly is not borne by one plate and thus the drive feature of the impeller is under less stress, while at the same time, the impeller components are clamped together in a substantially fluid tight relationship.

It will be understood that the invention disclosed and defined in this specification extends to all alternative combinations of two or more of the individual features mentioned or evident from the text or drawings. All of these different combinations constitute various alternative aspects of the invention.

What is claimed is:

1. An impeller assembly including:

an impeller, the impeller including:

a pair of plate means adapted for individual connection to a drive shaft for rotation by the drive shaft about an axis; and vane means disposed intermediate the pair of plate means and adapted for rotation with said pair of plate means;

wherein the impeller assembly further includes means for applying force parallel to the axis of the impeller to the impeller so as to clamp the pair of plate means and intermediate van means together; and wherein the one of the plate means has an outside annular portion which is tapered such that when force is applied parallel to the axis of the impeller to clamp the pair of plate means and intermediate vane means together the taped annular portion is caused to deform against the other means plate or vane means.

2. An impeller assembly including:

an impeller, the impeller including:

a pair of plate means adapted for individual connection to a drive shaft for rotation by the drive shaft about an axis; and vane means disposed intermediate the pair of plate means and adapted for rotation with said pair of plate means:

wherein the impeller assembly further includes means for applying force parallel to the axis of the impeller to the impeller so as to clamp the pair of plate means and intermediate vane means together;

the pair of plate means and vane means having a central aperture adapted to receive the drive shaft;

respective central apertures are keyed to the drive shaft such that each of the plate means and vane means is separately driven by the shaft;

the drive shaft has a portion larger in diameter than the keyed portion of the shaft thereby defining a step;

the means for applying force to the impeller is a combination of a stepped shaft, a tightening nut, and at least one of the pair of plate means;

the pair of plate means defines respective cover plates of the impellers; and wherein one of the cover plates has an outside annular portion which surrounds the central aperture and is tapered such that when force is applied parallel to the axis of the impeller to clamp the pair of plate means and intermediate vane means together by the tightening nut, the tapered annular portion is caused to deform against the adjacent upper cover plate or vane means.

3. An impeller assembly according to claim 1 or 2, wherein the pair of plate means define upper and lower cover plates of the impeller.

4. An impeller assembly according to claim 3, wherein the vane means defines fluid flow paths and is located intermediate the upper ad lower cover plates.

5. An impeller assembly according to claim 4, wherein both the pair of plate means incorporate the vane means.

6. An impeller assembly according to claim 4, wherein the vane means is formed integrally with the upper cover plate.

7. An impeller assembly according to claim 4, wherein the vane means is formed integrally with the lower cover plate.

8. An impeller assembly according to claim 4, wherein the vane means is a separate van plate which is disposed between the upper and lower cover plates.

9. An impeller assembly to claim 8, wherein the pair of plate means and the vane means include a central aperture adapted to receive the drive shaft.

10. An impeller assembly according to claim 9, wherein the respective central apertures are keyed to the drive shall such that each of the plate means and vane means is separately driven by the drive shaft.

11. An impeller assembly according to claim 9 or 10, wherein the respective central apertures, and a corresponding portion of the exterior surface of the drive shaft, are formed with pair of opposed flats.

12. An impeller assembly according to claim 9 or 10, wherein the respective central apertures, and a corresponding portion of the exterior surface of the drive shaft, are octagonal.

13. An impeller assembly according to claim 10, wherein the drive shaft includes a portion larger in diameter than the keyed portion of the shaft thereby defining a step.

14. An impeller assembly according to claim 13, wherein the means for applying force to the impeller is a combination of the stepped shaft, a tightening nut, and at least one of the pair of plate means.

15. An impeller assembly according to claim 14, wherein the means for applying force to the impeller includes both of the pair of plate means.

16. An impeller assembly according to claim 14 or 15, wherein the outside annular portion of the upper cover plate surrounding the central aperture, is tapered downwardly and outwardly from the central aperture, such that when force is applied to the upper cover plate by the tightening nut, the tapered portion is forced downwardly and caused to deform outwardly against the adjacent lower cover plate or vane means.

17. An impeller assembly according to claim 14 or 15, wherein the outside annular portion of the lower cover plate surrounding the central aperture, is tapered upwardly and outwardly from the central aperture, such that when force is applied to the lower cover plate by the tightening nut, the tapered portion of the lower cover plate is forced upwardly and caused to deform outwardly against adjacent upper cover plate or vane means.

18. An impeller assembly according to claim 14 or 15, wherein one end of the drive shaft includes a screw thread or similar corresponding to a screw thread on the tightening nut, the tightening nut in use being fitted to the drive shaft and tightened, such that respective spacers and impeller plates in the impeller assembly are clamped against the stepped portion of the drive shaft.

19. A pump for liquids, the pump including:

an impeller housing having an inlet port and an outlet port;

at least one impeller assembly, as defined in claims 1 or 2, located between the inlet port and the outlet port and operable to impel liquid from the inlet port to the outlet port.

20. A pump according to claim 19, including a plurality of impeller assemblies arranged in series between the inlet port and outlet port.

* * * * *